US010723000B2

(12) United States Patent
Evatt

(10) Patent No.: US 10,723,000 B2
(45) Date of Patent: Jul. 28, 2020

(54) MULTI-FUNCTION CLAMP

(71) Applicant: TTI (MACAO COMMERCIAL OFFSHORE) LIMITED, Macau (MO)

(72) Inventor: Thomas Evatt, Six Mile, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 171 days.

(21) Appl. No.: 15/884,004

(22) Filed: Jan. 30, 2018

(65) Prior Publication Data

US 2018/0215012 A1 Aug. 2, 2018

Related U.S. Application Data

(60) Provisional application No. 62/453,092, filed on Feb. 1, 2017.

(51) Int. Cl.

| | |
|---|---|
| ***B25B 5/06*** | (2006.01) |
| ***B25B 5/04*** | (2006.01) |
| ***B25B 5/16*** | (2006.01) |
| ***B25B 7/12*** | (2006.01) |

(52) U.S. Cl.

CPC ..... *B25B 5/067* (2013.01); *B25B 5/04* (2013.01); *B25B 5/163* (2013.01); *B25B 7/12* (2013.01)

(58) Field of Classification Search

CPC ..... B25B 1/2478; B25B 5/04; B25B 5/067; B25B 5/163; B25B 7/12; B25B 7/22; B25F 1/003

USPC ..... 269/139, 95; 29/260, 267, 278, 276; 81/308, 311, 310, 426.5, 57.5

See application file for complete search history.

(56) References Cited

U.S. PATENT DOCUMENTS

| | | | | |
|---|---|---|---|---|
| 1,334,425 | A * | 3/1920 | Wernimont | B25B 7/04 7/133 |
| 1,334,965 | A * | 3/1920 | Ridings | B25B 7/04 81/423 |
| 2,894,548 | A | 7/1959 | Peck et al. | |
| 3,052,462 | A | 8/1960 | Butler | |
| 3,044,081 | A * | 7/1962 | Robinson, Jr. | H05K 13/0007 7/107 |
| 3,425,098 | A * | 2/1969 | Bredvik | B25B 5/12 24/68 R |
| 4,134,578 | A | 1/1979 | Stanley | |
| 4,238,862 | A * | 12/1980 | Leatherman | B25B 7/22 7/128 |
| 5,322,396 | A | 6/1994 | Blacker | |

(Continued)

*Primary Examiner* — Joseph J Hail
*Assistant Examiner* — Arman Milanian
(74) *Attorney, Agent, or Firm* — Michael Best & Friedrich LLP

(57) ABSTRACT

A clamp includes a first arm, a first clamp member disposed at an end of the first arm, a link arm coupled to the first arm and movable relative to the first arm between a first position and a second position, and a second clamp member coupled to the link arm for movement therewith between the first position and the second position. The clamp also includes a second arm movable relative to the first arm and a third clamp member coupled to the second arm. The second and third clamp members are engageable with a workpiece to clamp the workpiece between the second and third clamp members when the link arm is in the first position. The first and third clamp members are engageable with the workpiece to clamp the workpiece between the first and third clamp members when the link arm is in the second position.

17 Claims, 3 Drawing Sheets

(56) References Cited

U.S. PATENT DOCUMENTS

| | | | | |
|---|---|---|---|---|
| 5,327,602 | A * | 7/1994 | Stenger | B25F 1/003 7/125 |
| 5,884,540 | A * | 3/1999 | Mo | B25B 7/04 81/423 |
| 6,029,964 | A | 2/2000 | Bohl | |
| 6,789,791 | B2 | 9/2004 | Genduso | |
| 6,893,012 | B2 | 5/2005 | Wong | |
| 7,104,166 | B1 | 9/2006 | Wong | |
| 7,415,912 | B2 | 8/2008 | Tyler | |
| 7,537,255 | B2 | 5/2009 | Key et al. | |
| 7,581,469 | B1 | 9/2009 | Clayborn | |
| 8,020,840 | B2 | 8/2011 | Hall, Jr. et al. | |
| 8,091,874 | B2 | 1/2012 | Ray Avalani | |
| 8,469,343 | B2 | 6/2013 | Clark | |
| 9,120,205 | B2 | 9/2015 | Clark | |
| 2005/0248074 | A1 | 11/2005 | Ray Avalani | |
| 2005/0280196 | A1 | 12/2005 | Ray Avalani | |
| 2007/0138723 | A1 | 6/2007 | Hsu et al. | |
| 2008/0309347 | A1 * | 12/2008 | Kurtz | B25B 7/00 324/522 |
| 2016/0193720 | A1 | 7/2016 | Vaale | |

* cited by examiner

MULTI-FUNCTION CLAMP

CROSS-REFERENCE TO RELATED APPLICATIONS

This application claims priority to U.S. Provisional Patent Application No. 62/453,092, filed on Feb. 1, 2017, the entire content of which is incorporated herein by reference.

FIELD OF THE INVENTION

The present invention relates to clamps, and more particularly to multi-function clamps.

BACKGROUND OF THE INVENTION

Clamps come in a variety of different types and styles. For example, a face clamp typically includes two clamp pads with planar clamping faces that abut opposite sides of a workpiece to be clamped. A pocket hole clamp typically includes clamp pad opposite a cylindrical projection. The cylindrical projection is insertable into a pocket hole in a workpiece, and the clamp pad engages an opposite side of the workpiece. Generally, multiple different clamps are needed to suit different applications.

SUMMARY OF THE INVENTION

The present invention provides, in one aspect, a clamp including a first arm, a first clamp member disposed at an end of the first arm, a link arm coupled to the first arm and movable relative to the first arm between a first position and a second position, and a second clamp member coupled to the link arm for movement therewith between the first position and the second position. The clamp also includes a second arm movable relative to the first arm and a third clamp member coupled to the second arm. The second clamp member and the third clamp member are engageable with a workpiece to clamp the workpiece between the second clamp member and the third clamp member when the link arm is in the first position. The first clamp member and the third clamp member are engageable with the workpiece to clamp the workpiece between the first clamp member and the third clamp member when the link arm is in the second position.

The present invention provides, in another aspect, a clamp comprising a first arm with a first clamp member disposed at the end, a link arm coupled to the first arm and movable relative to the first arm between a first position and a second position, a second clamp member coupled to the link arm for movement therewith between the first position and the second position, a second arm movable relative to the first arm, and a third clamp member coupled to the second arm. The clamp is configured as a face clamp when the link arm is in the first position and the clamp is configured as a pocket hole clamp when the link arm is in the second position.

The present invention provides, in another aspect, a clamp comprising a first arm including a cylindrical end portion, a first handle fixed to the first arm opposite the end portion, a second arm movable relative to the first arm, a second handle movable toward the first handle to move the second arm toward the first arm, a first clamp pad pivotally coupled to the second arm, and a second clamp pad movable between a first position in which the second clamp pad overlays the cylindrical end portion and a second position in which the second clamp pad is spaced from the cylindrical end portion. The clamp is configured as a face clamp when the second clamp pad is in the first position and the clamp is configured as a pocket hole clamp when the second clamp pad is in the second position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
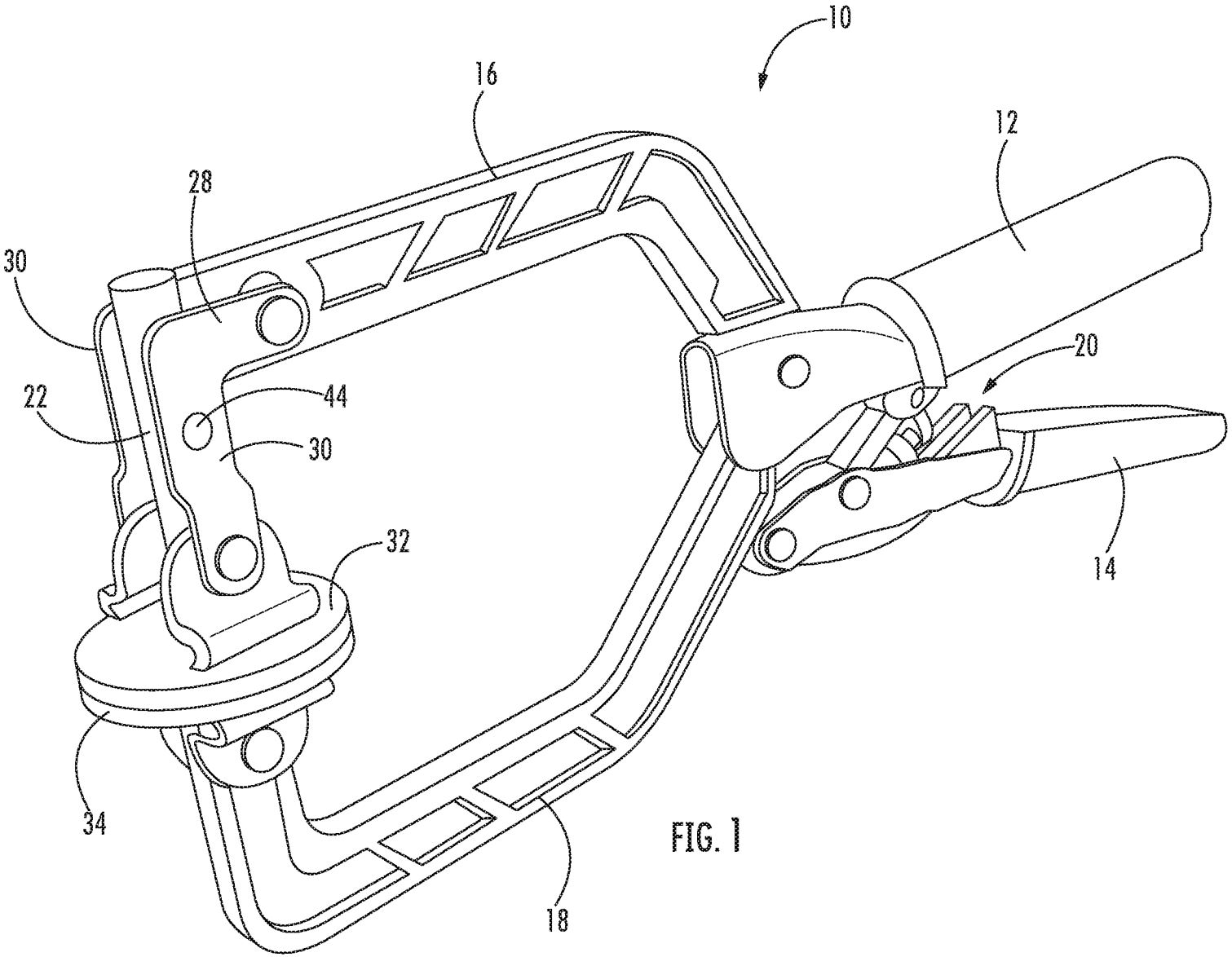
FIG. 1 is a perspective view of a clamp according to an embodiment of the invention, illustrated in a face clamp configuration.

FIG. 1 illustrates a multi-function clamp 10. The clamp 10 includes a first handle 12, a second handle 14, and first and second arms 16, 18 coupled to the handles 12, 14 via an over-center type linkage 20. In the illustrated embodiment, the first handle 12 is fixed to the first arm 18, and the second handle 14 is pivotally coupled to both the first arm 16 and the second arm 18. The second arm 18 is movable relative to the first arm 16 generally toward and away from the first arm 16 to open and close the clamp 10. In some embodiments, movement of the second handle 14 toward the first handle 12 causes the second arm 18 to move toward the first arm 16. In other embodiments, the handles 12, 14 and arms 14, 16 may be connected in other ways, giving the clamp 10 other configurations. For example, in some embodiments, the clamp 10 may be configured as a C-clamp or a bar clamp.

Figure 3:
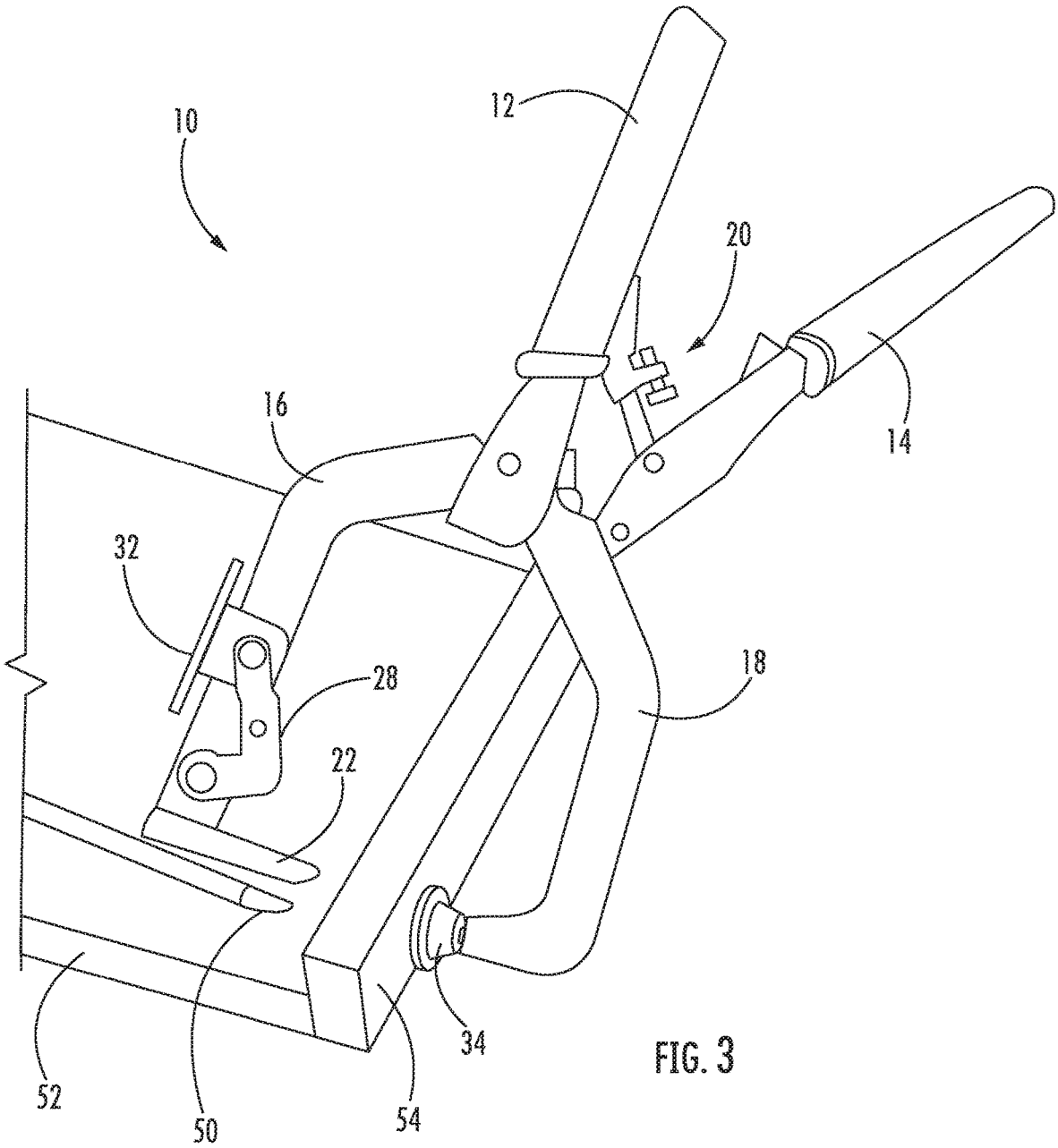
FIG. 3 is a perspective view of the clamp of FIG. 1 in use as a pocket hole clamp.

A first clamp member 22 is disposed at an end of the first arm 16 opposite the first handle 12. In the illustrated embodiment, the first clamp member 22 is a generally cylindrical end portion integrally formed with the first arm 16. The first clamp member 22 is configured for insertion into a pocket hole 50 (FIG. 3). In other embodiments, the first clamp member 22 may take other forms, such as a V-shaped member usable as a miter clamp. A link arm 28 is pivotally coupled to the arm 16 between the first clamp member 22 and the handle 12. In the illustrated embodiment, the link arm 28 includes first and second plates 30 positioned on opposite sides of the arm 16 and the first clamp member 22. In other embodiments, the link arm 28 may be disposed entirely on one side of the arm 16.

With continued reference to FIG. 1, a second clamp member 32, which is a swivel-type clamping pad in the illustrated embodiment, is pivotally coupled to the link arm 28, and a third clamp member 34 is disposed at an end of the second arm 18 opposite the second handle 14. The third clamp member 34 in the illustrated embodiment is also a swivel-type clamping pad and is pivotally coupled to the second arm 18. As such, the second clamp member 32 and the third clamp member 34 can each pivot independently relative to the link arm 28 and the arm 18, respectively. Planar clamp faces 36, 38 (FIG. 2) of the second clamp member 32 and the third clamp member 34 may thus remain in contact with a workpiece generally along the entire surface of the clamp faces 36, 38.

Figure 2:
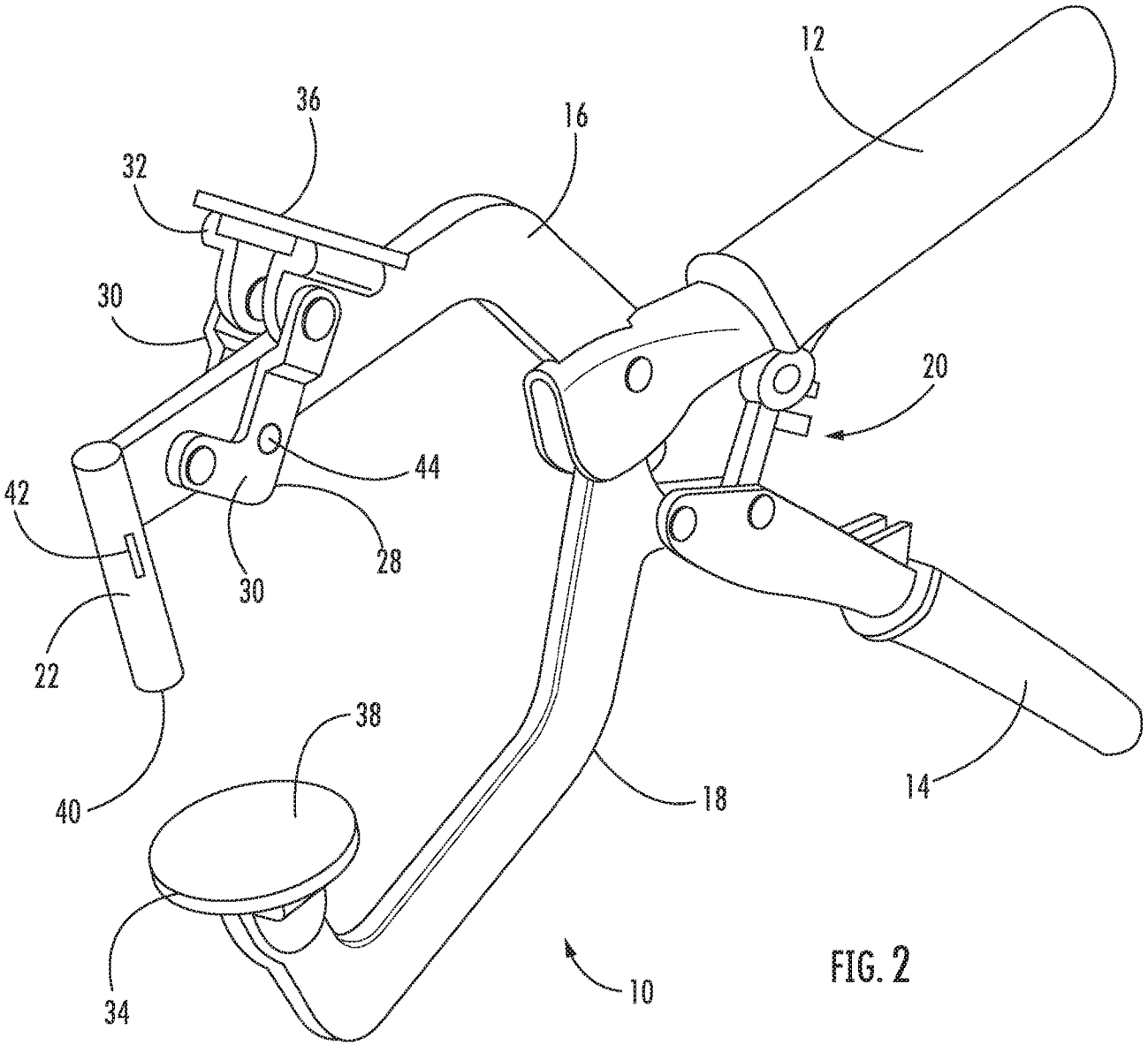
FIG. 2 is a perspective view of the clamp of FIG. 1, illustrated in a pocket hole clamp configuration.

The link arm 28 is movable relative to the arm 18 between a first position (FIG. 1) and a second position (FIGS. 2 and 3), with the second clamp member 32 moving therewith. In the second position (FIG. 2), the first clamp member 22 is exposed. In the first position (FIG. 1), the link arm 28 extends along the first clamp member 22, and the second clamp member 32 overlays a distal end 40 of the first clamp member 22. In the illustrated embodiment, a detent 42 is provided on the first clamp member 22 and a recess 44 on the link arm 28 (FIG. 2). The detent 42 and recess 44 are engageable to retain the link arm 28 in the first position, illustrated in FIG. 1. In some embodiments, the detent 42 may be provided on the link arm 28, and the recess 44 provided on the first clamp member 22

Referring to FIGS. 2 and 3, in the second position, the clamp 10 is usable as a pocket hole clamp. That is, the first clamp member 22 is received in a pocket screw hole 50 of a first workpiece 52 and the third clamp member 34 abuts a second workpiece 54 to clamp the workpieces 52 and 54 together. The link arm 28 (and with it, the second clamp member 32) is movable back to the first position (FIG. 1) to use the clamp 10 as a face clamp. In the first position of the link arm 28, the second clamp member 32 and the third clamp member 34 are used to abut and clamp workpieces. In the illustrated embodiment, the link arm 28 is illustrated as being attached to the first arm 16. In other embodiments, the link arm 28 can be attached to the second arm 18.

Various features of the invention are set forth in the following claims.

What is claimed is:

1. A clamp comprising:
- a first arm;
- a first clamp member disposed at an end of the first arm;
- a link arm coupled to the first arm and movable relative to the first arm between a first position and a second position;
- a second clamp member coupled to the link arm for movement therewith between the first position and the second position;
- a second arm movable relative to the first arm; and
- a third clamp member coupled the second arm,
- wherein the first clamp member is cylindrical such that the first clamp member is configured for insertion into a pocket hole,
- wherein the first clamp member extends from the first arm and terminates at a distal end,
- wherein the second clamp member is configured as a workpiece-engaging pad,
- wherein the second clamp member overlays the distal end when the link arm is in the first position,
- wherein the second clamp member and the third clamp member are engageable with a workpiece to clamp the workpiece between the second clamp member and the third clamp member when the link arm is in the first position, and
- wherein the first clamp member and the third clamp member are engageable with the workpiece to clamp the workpiece between the first clamp member and the third clamp member when the link arm is in the second position.

2. The clamp of claim 1, wherein one of the first clamp member and the link arm includes a detent and the other of the first clamp member and the link arm includes a recess configured to receive the detent to retain the link arm in the first position.

3. The clamp of claim 1, further comprising:
- a first handle fixed to the first arm; and
- a second handle pivotally coupled to the first arm and the second arm,
- wherein movement of the second handle toward the first handle moves the second arm toward the first arm.

4. The clamp of claim 3, wherein the link arm is pivotally coupled to the first arm between the first clamp member and the first handle.

5. The clamp of claim 3, further comprising an over-center linkage interconnecting the second handle with the first handle.

6. The clamp of claim 1, wherein the second clamp member is pivotally coupled to the link arm.

7. The clamp of claim 1, wherein the clamp is configured as a face clamp when the link arm is in the first position, and wherein the clamp is configured as a pocket hole clamp when the link arm is in the second position.

8. A clamp comprising:
- a first arm;
- a first clamp member disposed at an end of the first arm;
- a link arm coupled to the first arm and movable relative to the first arm between a first position and a second position;
- a second clamp member coupled to the link arm for movement therewith between the first position and the second position;
- a second arm movable relative to the first arm; and
- a third clamp member coupled the second arm,
- wherein one of the first clamp member and the link arm includes a detent and the other of the first clamp member and the link arm includes a recess configured to receive the detent to retain the link arm in the first position,
- wherein the clamp is configured as a face clamp when the link arm is in the first position and
- wherein the clamp is configured as a pocket hole clamp when the link arm is in the second position.

9. The clamp of claim 8, further comprising:
- a first handle fixed to the first arm; and
- a second handle pivotally coupled to the first arm and the second arm,
- wherein movement of the second handle toward the first handle moves the second arm toward the first arm.

10. The clamp of claim 9, further comprising an over-center linkage interconnecting the second handle with the first handle.

11. The clamp of claim 9, wherein the link arm is pivotally coupled to the first arm between the first clamp member and the first handle.

12. The clamp of claim 8, wherein the first clamp member is cylindrical.

13. The clamp of claim 8, wherein the second clamp member is pivotally coupled to the link arm.

14. The clamp of claim 8, wherein the first clamp member extends from the first arm and terminates at a distal end, and wherein the second clamp member overlays the distal end when the link arm is in the first position.

15. A clamp comprising:
- a first arm including a cylindrical end portion;
- a first handle fixed to the first arm opposite the end portion;
- a second arm movable relative to the first arm;
- a second handle movable toward the first handle to move the second arm toward the first arm,
- a first clamp pad pivotally coupled to the second arm; and a second clamp pad movable between a first position in which the second clamp pad overlays the cylindrical end portion and a second position in which the second clamp pad is spaced from the cylindrical end portion, wherein the clamp is configured as a face clamp when the second clamp pad is in the first position, and wherein the clamp is configured as a pocket hole clamp when the second clamp pad is in the second position.

16. The clamp of claim 15, wherein the cylindrical end portion includes a recess configured to receive a detent to retain the second clamp pad in the first position.

17. The clamp of claim 15, further comprising an over-center linkage interconnecting the second handle with the first handle.

* * * * *